United States Patent [19]

Röhrig

[11] Patent Number: 4,719,966

[45] Date of Patent: Jan. 19, 1988

[54] METHOD OF AND ARRANGEMENT FOR ADJUSTING A CONTINUOUS CASTING MOLD

[75] Inventor: Adalbert Röhrig, Thalwil, Switzerland

[73] Assignee: Concast Standard AG, Zürich, Switzerland

[21] Appl. No.: 37,220

[22] Filed: Apr. 10, 1987

[30] Foreign Application Priority Data

Apr. 15, 1986 [CH] Switzerland ..... 494/86

[51] Int. Cl.[4] ..... B22D 11/04

[52] U.S. Cl. ..... 164/491; 164/436

[58] Field of Search ..... 164/491, 436

[56] References Cited

FOREIGN PATENT DOCUMENTS 531374 5/1982 U.S.S.R. ..... 164/436

*Primary Examiner*—Kuang Y. Lin

*Attorney, Agent, or Firm*—Peter K. Kontler; Tobias Lewenstein

[57] ABSTRACT

A continuous casting mold has four walls each having a cooled surface and an end face. The walls are arranged so that the end face of each wall abuts the cooled surface of another wall. The cooled surfaces cooperate to define a casting passage of square or rectangular cross section. Two or more of the mold walls are shiftable transverse to the casting direction for the purpose of changing the dimensions of the casting passage. At least one of the shiftable walls is movable along a direction making an acute angle with the respective cooled surface.

16 Claims, 6 Drawing Figures

Fig. 1
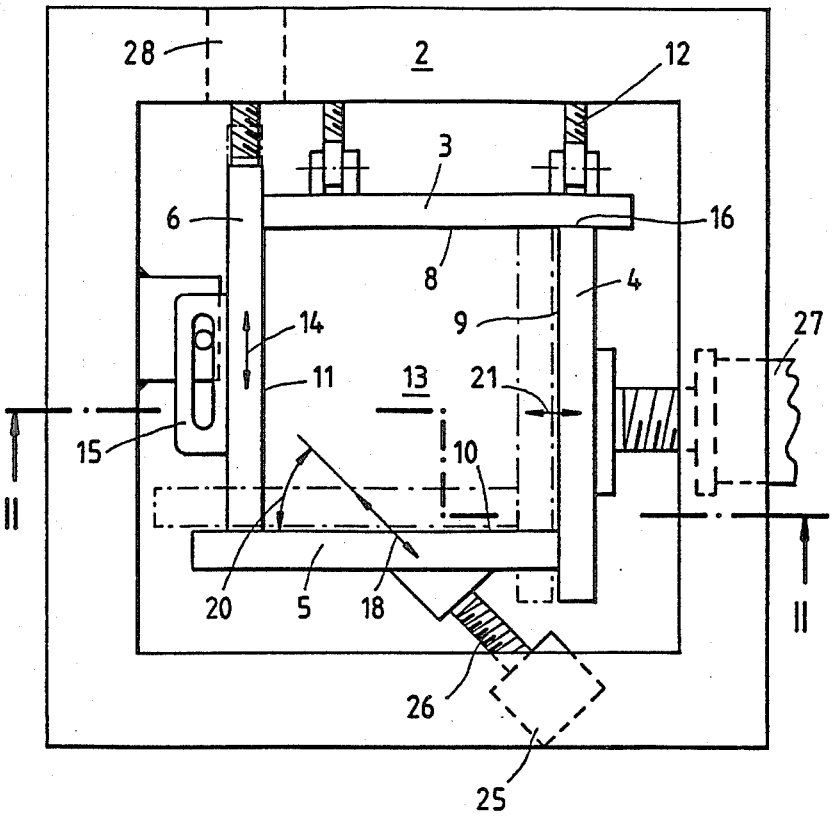
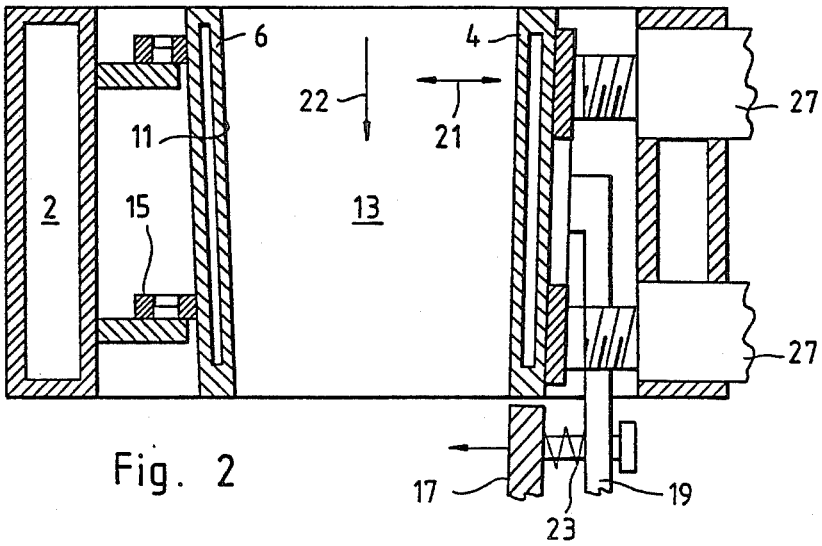
Fig. 2

Fig. 3
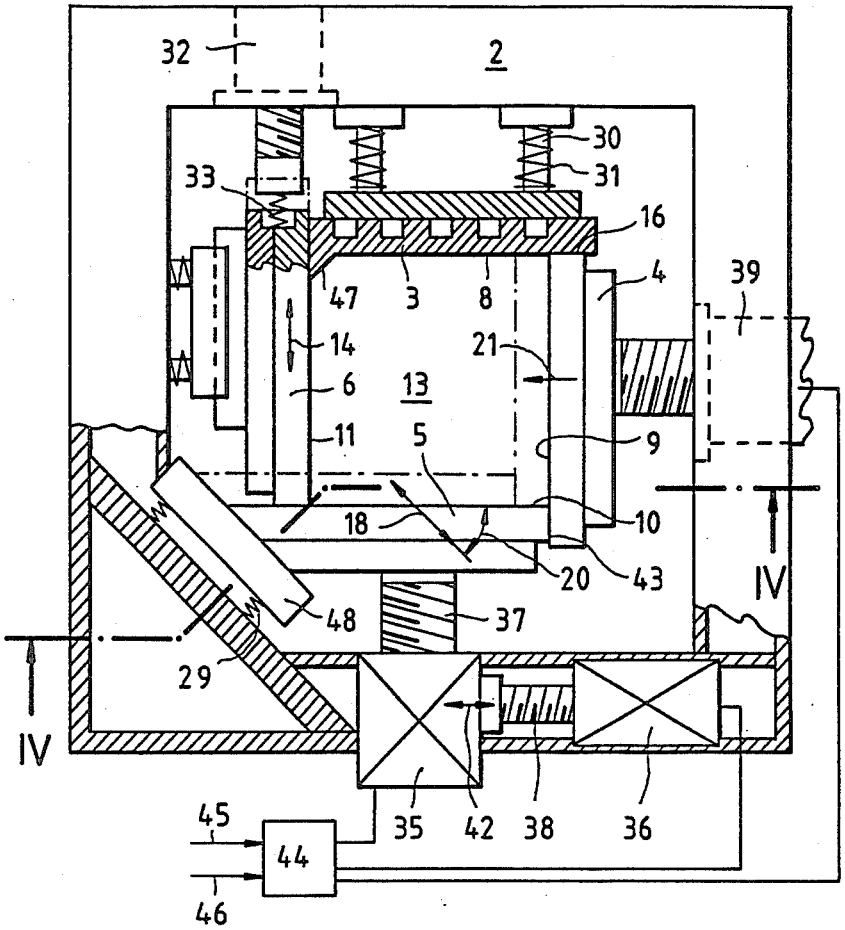
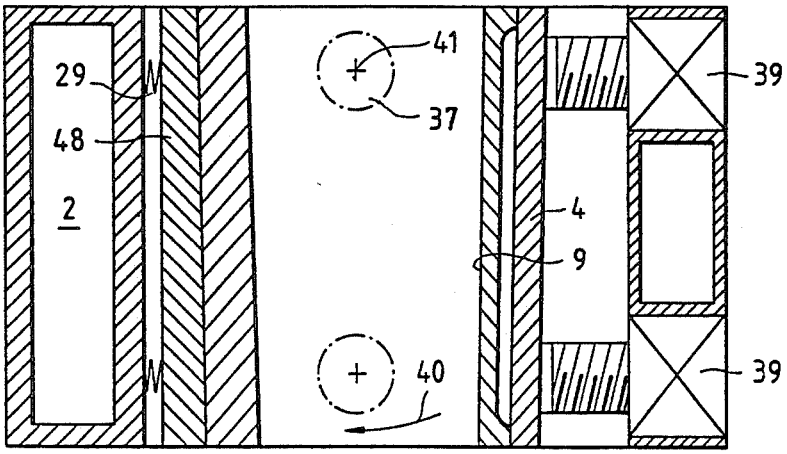
Fig. 4

METHOD OF AND ARRANGEMENT FOR ADJUSTING A CONTINUOUS CASTING MOLD

BACKGROUND OF THE INVENTION

The invention relates to a method of and an arrangement for adjusting a continuous casting mold, i.e., a method of and an arrangement for changing the dimensions of the mold cavity.

In the continuous casting of metal, especially steel, it is necessary to produce strands having different sizes or cross-sectional areas. The required size of a strand depends upon the shape and cross-sectional area of the final rolled product to be obtained from the strand. Adjustment of a continuous casting apparatus to stands of different sizes can be achieved by replacement of the mold or adjustment of the mold dimensions while the mold remains in the apparatus. Recently, it has become possible to remotely change the width of a slab mold during interruptions in a continuous casting operation as well as during a casting run.

For billets and blooms, there exists a need to change the cross-sectional area of the strand in two dimensions, that is, to change both the width and the thickness of the strand. For example, it is desirable to generate square cross sections of different sizes.

The British Patent Specification No. 977 433 discloses a continuous casting mold of rectangular cross section which is mounted on a frame or base plate. The mold includes four mold walls having cooled mold surfaces which cooperate to define a mold cavity or passage. Each of the mold walls has an end face which abuts the mold surface of a neighboring mold wall at the corner of the mold cavity. The four mold walls are held together by carriage bolts. An adjusting screw for changing the dimensions of the mold cavity is disposed between the frame and each of the mold walls. The mold walls are movable transverse to the casting direction in order to permit adjustments in mold taper and in the relative positions of the mold walls. Adjustment of a mold of this type is time-consuming and is usually performed in the mold shop. Furthermore, the range of adjustments is restricted and readjustments require the use of templates as well as measuring instruments.

OBJECTS AND SUMMARY OF THE INVENTION

It is an object of the invention to provide a method which makes it possible to adjust a mold cavity in two dimensions, i.e., in width and thickness, relatively simply.

Another object of the invention is to provide a method which creates the possibility of changing the size of a mold cavity in two dimensions while the mold is in a continuous casting apparatus and even during a casting run.

An additional object of the invention is to provide a method which not only permits adjustment of a mold cavity in two dimensions but also makes it possible to change the mold or casting taper.

A further object of the invention is to provide a continuous casting mold in which the mold cavity may be adjusted in two dimensions, i.e., in width and thickness, relatively simply.

It is also an object of the invention to provide a continuous casting mold which enables the size of the mold cavity to be changed in two dimensions while the mold is mounted in a continuous casting apparatus and even during a casting run.

Yet another object of the invention is to provide a continuous casting mold which makes it possible to adjust the mold cavity in two dimensions as well as to adjust the mold or casting taper.

The preceding objects and others are achieved by the invention.

One aspect of the invention resides in a method of changing the dimensions of a generally square or rectangular mold cavity defined by four cooled mold surfaces. The method involves shifting at least two of the mold surfaces transverse to the casting direction, and the shifting step for at least one of these surfaces is performed in such a manner that such surface moves along a direction making an acute angle therewith.

Another aspect of the invention relates to a continuous casting mold. The mold comprises a mold frame, and four mold walls mounted on the frame and each having a cooled mold surface and an end face. Each of the end faces abuts the mold surface of a neighboring mold wall so that the mold surfaces cooperate to define a generally square or rectangular mold cavity. The mold further comprises means for shifting at least two of the mold walls transverse to the casting direction. The shifting means includes at least one shifting mechanism arranged to move one of the two walls along a direction making an acute angle with the respective mold surface.

The method and mold of the invention make it possible to remotely effect two-dimensional adjustment of a mold during an adjustment cycle while the mold is mounted in a continuous casting apparatus. If desired, the adjustment may even be performed during a casting run. Alignment of the mold relative to a strand guide located downstream of the mold may be achieved by designing one of the mold walls as a fixed side of the mold which remains essentially fixed during adjustment. This mold wall may, if desired, be rigidly connected to the mold frame.

In order to change the cross-sectional area of the mold cavity, it is possible, for instance, to displace a first mold wall along a direction making an acute angle with its mold surface. A second mold wall may then be displaced at right angles to the respective mold surface while a third mold wall is displaced parallel to its mold surface.

According to a further advantageous embodiment of the method, all four mold walls may be shifted simultaneously along directions making acute angles with the respective mold surfaces. Here, a shifting mechanism is provided for each mold wall and is arranged to move the respective wall relative to the mold frame along a direction making an acute angle with the respective mold surface. The shifting mechanisms are preferably in the form of spindles and may be designed so as to displace the mold walls along directions making angles of 45° with the respective mold surfaces. However, for adjustments involving mold cavities of rectangular cross section, the acute angles between the directions of movement of the wider mold walls and their associated mold surfaces will be different from the acute angles between the directions of movement of the narrower mold walls and the corresponding mold surfaces.

In order to maintain the geometry of the continuous casting apparatus, it may frequently be desirable for the mold to have a fixed side or wall, as considered transverse to the casting direction, also in those cases where different adjustments in cross section are carried out. To achieve this result for a mold having four movable walls, the mold frame may be mounted so as to be movable relative to the support structure of the continuous casting apparatus in a direction transverse to the casting direction. An appropriate moving mechanism may be provided to shift the frame relative to the support structure. The moving mechanism is controlled such that, upon displacement of the mold wall which is to constitute the fixed side of the mold through a predetermined distance, the frame is simultaneously moved through the same distance in the opposite direction.

According to another embodiment of the invention, alignment of the mold relative to strand support elements disposed downstream of the mold may be achieved in two dimensions by designing two of the mold walls as fixed sides or walls. One such wall remains essentially completely stationary during adjustment while the other wall moves during adjustment but only in its own plane, i.e., both walls remain fixed as considered in a direction transverse to the casting direction.

Movement of a mold wall along a direction which is inclined with respect to the respective mold surface can be achieved by a variety of mechanisms. A relatively simple and inexpensive design is obtained when the shifting mechanism for the mold wall includes a worm gear spindle which defines an acute angle with the mold surface of the wall.

During adjustment of mold cavities having rectangular cross sections, the mold wall is displaced along a diretion which makes an acute angle of either less or more than 45° with the respective mold surface. If the adjustments are to involve mold cavities of both square and rectangular cross section, it may be of particular advantage for the shifting mechanism which functions to shift the mold wall to include two spindles disposed at right angles to one another. The spindles may be connected to a control mechanism or computer which operates to move the spindles at a predetermined speed relative to one another.

To permit adjustments in the size of a mold cavity during a casting run, the shifting means for the two or more movable mold walls may be connected to a control mechanism or computer which causes the movable mold walls to simultaneously undergo preprogrammed displacements in such a manner that, at the corners of the mold, the end faces of the mold walls remain in contact with the mold surfaces of the neighboring mold walls.

As mentioned earlier, two of the mold walls may constitute fixed sides or walls of the mold. In accordance with another embodiment of the invention, these walls are arranged in parallelism with the longitudinal axis of the strand, i.e, have no taper, while the two movable mold walls are positioned so as to impart a taper to the mold cavity. Since it may be necessary to change the mold taper when an adjustment is made in the size of the mold cavity, it is further proposed to mount at least the two movable mold walls for limited pivotal movement about respective axes extending parallel to the respective mold surfaces and transverse to the casting direction. Suitable pivoting devices may be provided to tilt the movable mold walls.

The formation of gaps at the corners of the mold during adjustments in mold size, especially when the adjustments are performed in the course of a casting run, can lead to disturbances in a casting operation or to interruption of the latter. Accordingly, a further embodiment of the invention provides for at least one of the mold walls to be mounted for limited movement transverse and/or parallel to the respective mold surfaces under the action of resilient elements. Such a design allows the mold taper to be set, as well as adjusted after a change in mold cavity size, using minimal means.

In an additional embodiment of the invention, the mold walls are resiliently supported on respective carrier walls or carriers in such a manner that each mold wall can shift slightly in a direction parallel to the respective mold surface and transverse to the casting direction. The resilient force is selected so that the end face of a mold wall is automatically pressed against the mold surface of the neighboring mold wall with adequate pressure. This embodiment of the invention makes it possible to suspend the mold walls with minimum play and maximum precision, on the one hand, and to reliably prevent the formation of gaps in the mold corners, on the other hand.

Various circumstances including changes in mold cavity size, changes in the composition of the steel being cast, changes in casting speed and mold wear may make it necessary or desirable to change the mold taper during a casting run or between runs. To this end, yet another embodiment of the invention provides for the shifting mechanism of each movable mold wall to be mounted on the mold frame for pivotal movement about an axis extending parallel to the respective mold surface. In order to permit automatic adjustment of the mold taper during a casting run, a remotely controlled pivoting device may be interposed between the frame and each shifting mechanism.

The novel features which are considered as characteristic of the invention are set forth in particular in the appended claims. The improved continuous casting mold itself, however, both as to its construction and its mode of operation, together with additional features and advantages thereof, will be best understood upon perusal of the following detailed description of certain specific embodiments when read in conjunction with the accompanying drawings.

BRIEF DESCRIPTION OF THE DRAWING

FIG. 1 is a plan view of one embodiment of a continuous casting mold according to the invention;

FIG. 2 is a vertical sectional view as seen in the direction of the arrows II—II of FIG. 1;

FIG. 3 is a partly sectional plan view of another embodiment of a continuous casting mold of accordance with the invention;

FIG. 4 is a vertical sectional view as seen in the direction of the arrows IV—IV of FIG. 3;

DESCRIPTION OF THE PREFERRED EMBODIMENTS

Figure 5:
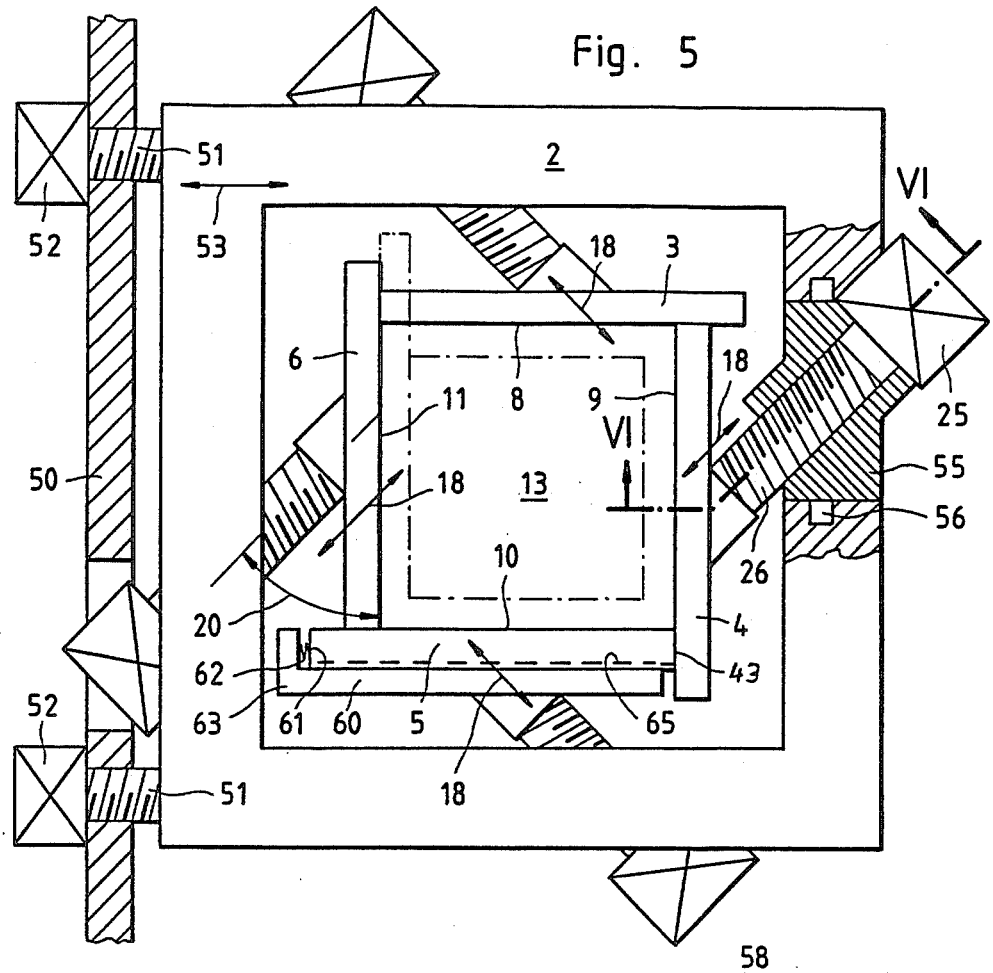
FIG. 5 is a partly sectional plan view of an additional embodiment of a continuous casting mold according to the invention.

FIGS. 1 and 2 illustrate a continuous casting mold having a mold cavity or casting passage 13. The mold cavity 13 is shown as having a square cross section but could also have a rectangular cross section. The mold includes a base plate or mold frame 2, and four mold walls 3,4,5,6 which are mounted on the frame 2 and have respective mold surfaces 8,9,10,11. The mold surfaces 8–11, which are cooled in a conventional manner, cooperate to define the mold cavity 13. Each of the mold walls 3–6 has an end face such as that indicated at 16 for the mold wall 4, and the end faces abut the mold surface 8,9,10 or 11 of the neighboring mold wall 3,4,5 or 6. The locations at which the end faces and mold surfaces 8–11 meet constitute the corners of the mold cavity 13. The cross section of the mold cavity 13 is adjustable and a plurality of motorized mechanisms to be described below are provided for this purpose.

The mold wall 3 constitutes a fixed side or wall of the mold. The mold wall 3 is here considered to be fixed in the sense that it remains stationary during changes in the cross section of the mold cavity 13 or moves only as necessary to adjust the mold or casting taper to the new dimensions of the mold cavity 13. The mold wall 3 may be adjustably mounted on the frame 2 via spindles 12 or other suitable means, or may be rigid with the frame 2.

The mold wall 6 may also be considered to constitute a fixed side or wall of the mold since it moves only in the directions indicated by the double-headed arrow 14, i.e., only in its own plane, during adjustments in the dimensions of the mold cavity 13. The mold wall 6 thus remains fixed as considered in the directions which are shown by the double-headed arrow 21 and extend transverse to the casting direction 22. Inasmuch as the mold wall 6 is displaced only in its own plane and does not shift in the directions 21, the mold wall 6 remains in alignment with strand support elements such as that illustrated at 17 and located downstream of the mold. Movement of the mold wall 6 in the directions 14 is effected by a pair of shifting devices 28, e.g., a pair of worm gear spindles, arranged one above the other. The reference numeral 15 identifies a member which functions as a hanger and guide for the mold wall 6.

In order to permit changes in the dimensions or size of the mold cavity 13, the mold wall 4 is movable in the directions 21 to thereby change the distance between the mold wall 4 and the opposed mold wall 6. Such movement of the mold wall 4 is achieved via shifting devices 27, e.g., worm gear spindles having appropriate drives.

In the embodiment of FIGS. 1 and 2, the mold wall 5 is movable along a path indicated by the double-headed arrow 18. To this end, the mold wall 5 is connected to a shifting device 25 which comprises a driven worm gear spindle 26. The shifting device 25 may constitute a carrier for the mold wall 5 and serves as a bridge between the latter and the mold frame 2. The path 18 and the spindle 26 each define an acute angle 20 with the mold surface 10 of the mold wall 5. Since the mold cavity 13 has a square cross section, the angle 20 is here 45°. If the mold cavity 13 were rectangular, the angle 20 would normally be different from 45° and could be either greater or less than this value. New positions of the mold walls 4, 5 and 6 following a reduction in the size of the mold cavity 13 are shown in FIG. 1 by phantom lines.

The strand support element 17 disposed downstream of the mold is here assumed to be in the form of a cooling plate. The cooling plate 17 is mounted on the movable mold wall 4 via a carrier 19. Thus, the cooling plate 17 shifts together with the mold wall 4. It is noted that only a single cooling plate 17 is shown in FIG. 2 to preserve clarity and that similar cooling plates are disposed beneath the mold walls 3, 5 and 6. One or more springs 23 are arranged between the cooling plate 17 and the carrier 19. The spring or springs 23 urge the cooling plate 17 against a strand issuing from the mold with a predetermined force. Accordingly, it is possible to compensate for unevenness of the strand without loss of contact between the latter and the cooling plate 17, particularly when the mold wall 4 is moved during the course of a casting run.

Referring now to FIGS. 3 and 4, the same reference numerals as in FIGS. 1 and 2 are used to identify the same elements.

In the embodiment of FIGS. 3 and 4, the mold wall 5 again moves along the path 18 which defines an acute angle with the mold surface 10 of the mold wall 5. However, the shifting mechanism for the mold wall 5 here includes a shifting device 36 having a spindle 38 and a second shifting device 35 having a spindle 37. The spindles 37 and 38 extend at right angles to one another, and the spindle 37 is connected to the mold wall 5 while the spindle 38 is connected to the shifting device 35. It will be noted that the spindle 37 is normal to the mold surface 10 of the mold wall 5 whereas the spindle 38 is parallel to the mold surface 10. Thus, the movement of the mold wall 5 along the path 18 is a resultant of the movements of the spindles 37 and 38. the shifting devices 35 and 36 are connected to a conventional control unit or computer 44 which causes the spindles 37 and 38 to move at a predetermined relative speed.

The mold wall 5 has an end face 43 which abuts the mold surface 9 of the mold wall 4. The opposite end face of the mold wall 5 is in engagement with a biasing member 48 which is resiliently urged against such end face by springs 29 interposed between the biasing member 48 and the mold frame 2. The biasing member 48 biases the end face 43 of the mold wall 5 towards the mold surface 9 of the mold wall 4 with a predetermined force as the mold walls 4 and 5 are shifted in the directions 21 and 18 to thereby prevent the formation of a gap between the mold walls 4 and 5.

The resilient biasing force can also prevent the formation of a gap between the mold walls 4 and 5 during adjustments in the taper of the mold wall 4. In order to adjust the taper of the mold wall 4 and to prevent the formation of a gap between the latter and the mold wall 5 during the adjustment, the mold walls 4 and 5 must be mounted on the mold frame 2 for limited pivotal movement. Pivotal movement of the mold wall 4 for taper adjustment can be effected by a pair of shifting devices 39 which are arranged one above the other. The arrow 40 in FIG. 4 illustrates a pivotal movement of the mold wall 5, e.g., abut the central axis 41 of the spindle 37 seen in FIG. 3.

The mold wall 3 is mounted on the frame 2 by means of bolts 30 and is resiliently biased relative to the frame 2 via springs 31 which are interposed between the frame 2 and the mold wall 3. The mold wall 6, on the other hand, is supported on the frame 2 through the agency of shifting devices 32 which function to move the mold wall 6 in the directions 14. similarly to the mold wall 3, the mold wall 6 is resiliently biased relative to the frame 2 by means of spring packs 33 which are disposed between the mold wall 6 and the shifting devices 32. It will be noted that the springs 31 bias the mold wall 3 transverse to the respective mold surface 8 while the spring packs 33 bias the mold wall 6 parallel to the respective mold surface 11. The mold wall 6 may further be biased transverse to its mold surface 11 by springs 70. The resilient mounting of the mold walls 3 and 6 on the frame 2 helps to prevent the formation of gaps at the corners of the mold cavity 13 during adjustments of the mold walls 4–6 and makes it possible to compensate for small adjustments in taper which may be required when the dimensions of the mold cavity 13 are changed.

The control unit 44 is connected to the shifting devices 32 and 39 as well as to the shifting device 35 and 36. The control unit 44 has a pair of inputs 45,46 and regulates the displacements of the mold walls 4–6 based on instructions supplied to the inputs 45,46. The control unit 44 makes it possible to simultaneously shift two or more of the mold walls 4–6 in such a manner that, at the corners of the mold cavity 13, the end faces of the mold walls 3–6 remain in contact with the neighboring mold surfaces 8–11.

If the spring forces which are used to hold the mold walls 3–6 together are large, hydraulic cylinders may be provided to counteract the spring forces and reduce the latter to a desired level during adjustments of the mold walls 3–6.

As illustrated at 47 in FIG. 3 by way of example, the corners of the mold cavity 13 may be beveled rather than right-angled. Although the mold cavity 13 as well as the resulting strand then have eight longitudinal edges each, both the mold cavity 13 and the strand may nevertheless be considered to be of square or rectangular cross section.

Figure 6:
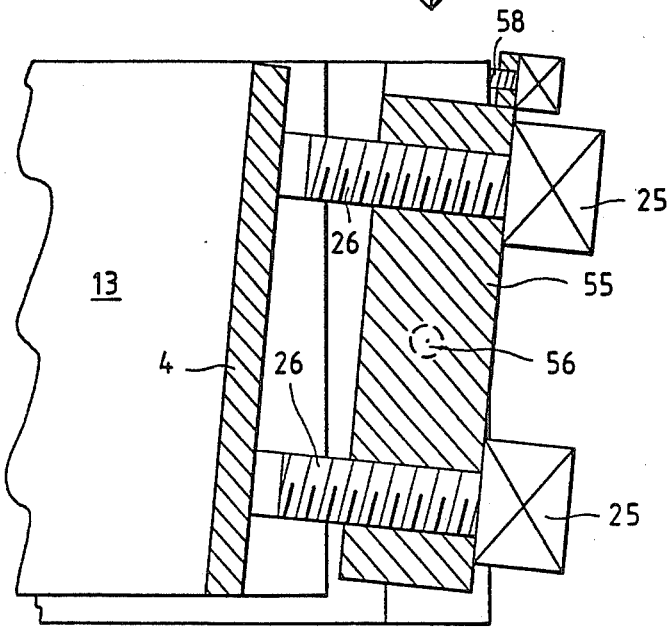
FIG. 6 is a fragmentary vertical sectional view as seen in the direction of the arrows VI—VI of FIG. 5.

Turning now to FIGS. 5 and 6, the same reference numerals as in FIGS. 1 and 2 are used to identify the same elements.

In the mold of FIGS. 5 and 6, all of the mold walls 3–6 are connected to the same type of shifting mechanism. As illustrated, each of the shifting mechanisms preferably includes the shifting device 25 of FIG. 1 which comprises a spindle 26. When the dimensions of the mold cavity 13 are to be changed, e.g., during a casting run, all four mold walls 3–6 can be moved simultaneously along respective paths indicated by the arrows 18. The paths 18 as well as the spindles 26 again define acute angles 20 with the corresponding mold surfaces 8–11. As before, each of the angles 20 is 45° when the mold cavity 13 is of square cross section.

In the embodiment of FIGS. 5 and 6, the mold wall 6 constitutes a fixed side or wall of the mold which advantageously does not shift relative to a fixed side of a strand guide located downstream of the mold or relative to an axis of the continuous casting apparatus. The reference numeral 50 identifies support structure of the continuous casting apparatus, and the mold frame 2 is mounted on the support structure 50 by means of two moving mechanism each of which includes a spindle 51 and a spindle drive 52. As indicated by the double-headed arrow 53, the moving mechanisms 51,52 can displace the frame 2, and hence the entire mold, relative to the support structure 50 in directions transverse to the casting direction. When the mold wall 6 is shifted along the respective path 18 and consequently moves a predetermined distance along the path 53, the moving mechanisms 51,52 can simultaneously move the frame 2 through the same distance but in the opposite direction. The mold wall 6 then remains stationary with respect to the axis of the continuous casting apparatus although it shifts relative to the mold frame 2.

One or more of the mold walls 3–6 may be mounted on the mold frame 2 for pivotal movement together with the associated shifting mechanism 25,26. This is illustrated on the left-hand side of FIGS. 5 and 6 for the mold wall 4 and its shifting mechanism 25,26. The reference numeral 55 identifies a spindle guide or support which is pivotally mounted on the frame 2 via a pivot pin 56 extending parallel to the mold surface 9 of the mold wall 4 and transverse to the casting direction. The spindle guide 55 receives the spindle 26 of the mold wall 4. A motorized pivoting mechanism 58 mounted on the frame 2 and connected to the spindle guide 55 operates to pivot the latter on the pivot pin 56 to thereby change the inclination of the mold wall 4 and the taper of the mold cavity 13, e.g., during displacement of the mold wall 4.

The mold wall 5 is supported by an L-shaped carrier wall or carrier having a long leg 60 which parallels the mold surface 9 of the mold wall 5 and a short leg 63 which extends normal to the mold surface 9. The mold wall 5 is slidable along the long leg 60 which guides the mold wall 5 for movement parallel to the mold surface 9 and transverse to the casting direction. The mold wall 5 has an end face 61 which confronts the short leg 63 of the L-shaped carrier, and a spring 62 is interposed between the leg 63 and the end face 61. The spring 62 urges the end face 43 of the mold wall 5 into engagement with the mold surface 9 of the mold wall 4 with a predetermined force. The spring 62 is operative to maintain a certain biasing force at the seam between the mold walls 4 and 5 both during and after adjustments in the dimensions and taper of the mold cavity 13.

A guide 65 is interposed between the mold wall 5 and the long leg 60 of the L-shaped carrier and is capable of following the pivotal movements which occur about the pivot pin 56 during adjustments in the taper of the mold wall 4. Alternatively, it is possible, for example, to provide an elastic buffer between the mold wall 5 and the associated spindle 26 for the purpose of absorbing small pivotal movements.

Each of the remaining mold walls 3, 4 and 6 in FIGS. 5 and 6 may be mounted in the same manner as described for the mold wall 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of changing the dimensions of a generally square or rectangular continuous casting mold cavity defined by four cooled mold surfaces, comprising the step of shifting at least two of said surfaces transverse to the casting direction, the shifting step for at least one of said two surfaces being performed in such a manner that said one surface moves along a direction making an acute angle with said one surface.

2. The method of claim 1, further comprising the step of maintaining an additional one of said surfaces essentially fixed during the shifting step.

3. The method of claim 1, wherein the shifting step comprises shifting each of said four surfaces along a direction making an acute angle with the respective surface.

4. The method of claim 3, wherein a selected one of said surfaces is displaced a predetermined distance in a predetermined direction during the shifting step; and further comprising the step of moving said mold cavity through said predetermined distance counter to said predetermined direction during the shifting step.

5. A continuous casting mold, comprising a mold frame; four mold walls mounted on said frame and each having a cooled mold surface and an end face, each of said end faces abutting the mold surface of a neighboring wall so that said surfaces cooperate to define a generally square or rectangular mold cavity; and means for shifting at least two of said walls transverse to the casting direction, said shifting means including at least one shifting mechanism arranged to move one of said two walls along a direction making an acute angle with the respective mold surface.

6. The mold of claim 5, wherein said shifting means includes four shifting mechanisms each of which is arranged to move a respective wall along a direction making an acute angle with the respective mold surface.

7. The mold of claim 6, wherein at least one of said shifting mechanisms comprises a spindle.

8. The mold of claim 6, wherein at least one of said angles is 45°.

9. The mold of claim 5, wherein said shifting mechanism is mounted on said frame for pivotal movement about an axis substantially paralleling the mold surface of said one wall.

10. The mold of claim 9, comprising a guide for said shifting mecahnism, said guide being mounted on said frame for pivotal movement about said axis, and said shifting mecahnism being mounted in said guide; and further comprising a pivoting device in engagement with said frame and said guide.

11. The mold of claim 5, wherein said shifting mechanism comprises a pair of spindles extending at right angles to one another; and further comprising control means for moving said spindles at a predetermined relative speed.

12. The mold of claim 5, wherein the end face of a first one of said two walls abuts the mold surface of the second of said two walls; and further comprising control means connected with said shifting means and arranged to effect preprogrammed simultaneous displacements of said two walls in such a manner that the end face of said first wall remains in abutment with the mold surface of said second wall during shifting of said two walls.

13. The mold of claim 5, wherein each of said two walls is mounted on said frame for pivotal movement about an axis substantially paralleling the respective mold surface.

14. The mold of claim 5, further comprising resilient biasing means biasing at least one of said walls in a direction transverse to the respective mold surface.

15. The mold of claim 5, comprising a carrier for a selected one of said walls, said selected wall being mounted on said carrier for movement along a direction transverse to the casting direction and substantially paralleling the respective mold surface; and further comprising a resilient biasing element biasing the end face of said selected wall towards the mold surface of the neighboring wall.

16. The mold of claim 5, comprising a support for said frame, and moving means for moving said frame relative to said support transverse to the casting direction.

* * * * *